US011839308B2

(12) United States Patent
Ribicic

(10) Patent No.: US 11,839,308 B2
(45) Date of Patent: Dec. 12, 2023

(54) MATTRESS

(71) Applicant: Vanema d.o.o., Zagorje ob Savi (SI)

(72) Inventor: Boris Ribicic, Ljubljana (SI)

(73) Assignee: Vanema d.o.o., Zagorje ob Savi (SI)

( * ) Notice: Subject to any disclaimer, the term of this patent is extended or adjusted under 35 U.S.C. 154(b) by 232 days.

(21) Appl. No.: 16/486,931

(22) PCT Filed: Nov. 9, 2017

(86) PCT No.: PCT/EP2017/078812
§ 371 (c)(1),
(2) Date: Aug. 19, 2019

(87) PCT Pub. No.: WO2018/149523
PCT Pub. Date: Aug. 23, 2018

(65) Prior Publication Data

US 2020/0229607 A1 Jul. 23, 2020

(30) Foreign Application Priority Data

Feb. 20, 2017 (DE) ..... 102017103453.6

(51) Int. Cl.
*A47C 27/05* (2006.01)
*A47C 27/06* (2006.01)
(Continued)

(52) U.S. Cl.
CPC ..... *A47C 27/056* (2013.01); *A47C 27/064* (2013.01); *A47C 27/146* (2013.01);
(Continued)

(58) Field of Classification Search
CPC ... A47C 27/056; A47C 27/053; A47C 27/064; A47C 27/146; A47C 27/142; A47C 27/20; A47C 27/15; A47C 27/144; A47C 27/05
See application file for complete search history.

(56) References Cited

U.S. PATENT DOCUMENTS 1,852,943 A * 4/1932 Swanson ..... A47C 27/063 267/93
2,469,084 A * 5/1949 Schenker ..... A47C 27/16 5/728
(Continued)

FOREIGN PATENT DOCUMENTS

CN 104873031 A 9/2015
DE 20212742 U1 8/2003
(Continued)

*Primary Examiner* — Justin C Mikowski
*Assistant Examiner* — Morgan J McClure
(74) *Attorney, Agent, or Firm* — Murphy, Bilak & Homiller, PLLC

(57) ABSTRACT

The invention relates to a mattress (1, 1', 2, 3) having at least one first layer (10, 20, 30), a second layer (12, 22, 32) and a third layer (14, 24, 34), the second layer (12, 22, 32) comprising spring elements (16, 26, 36) and being interposed between the first layer (10, 20, 30) and the third layer (14, 24, 34). The thickness ($a_1$, $a_2$, $a_3$, $d_1$, $d_2$, $d_3$, . . . , $d_{10}$) of the third layer (14, 24, 34) varies locally to an extent that exceeds the extent defined by a surface structure of the third layer (14, 24, 34) on its exterior surface (17).

12 Claims, 6 Drawing Sheets

Figure 1:
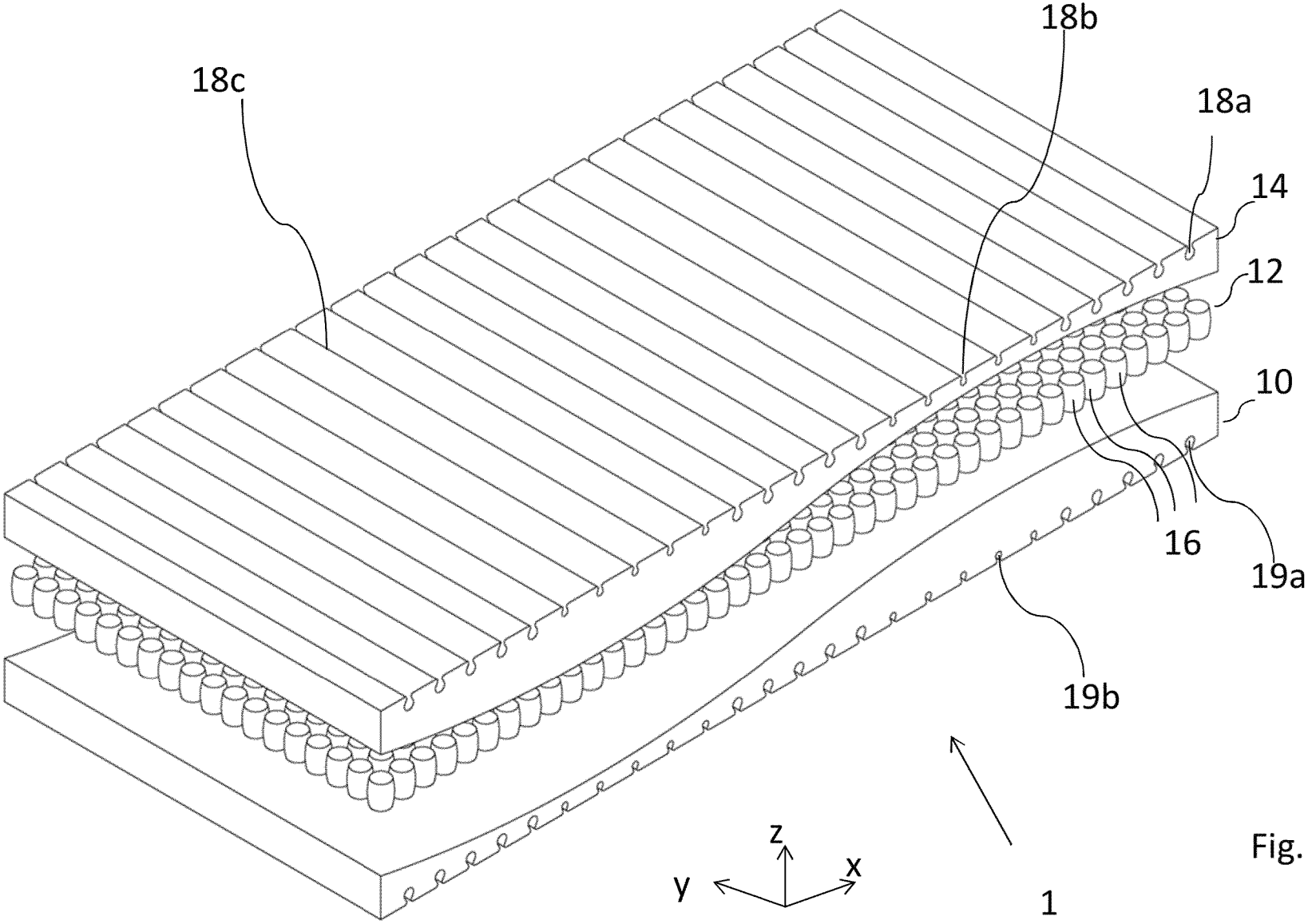

(51) Int. Cl.

| | |
|---|---|
| ***A47C 27/04*** | (2006.01) |
| ***A47C 27/15*** | (2006.01) |
| ***A47C 27/20*** | (2006.01) |
| ***A47C 27/14*** | (2006.01) |

(52) U.S. Cl.
CPC ..... *A47C 27/15* (2013.01); *A47C 27/05* (2013.01); *A47C 27/053* (2013.01); *A47C 27/142* (2013.01); *A47C 27/144* (2013.01); *A47C 27/20* (2013.01)

(56) References Cited

U.S. PATENT DOCUMENTS

| | | | | | |
|---|---|---|---|---|---|
| 3,885,258 | A * | 5/1975 | Regan | A47C 27/144 | 5/727 |
| 4,047,254 | A * | 9/1977 | Hamasu | A47C 27/144 | 5/740 |
| 4,053,957 | A * | 10/1977 | Regan | A47C 23/00 | 5/727 |
| 7,100,229 | B2 * | 9/2006 | O'Reagan | A47C 27/146 | 5/731 |
| 8,832,889 | B2 * | 9/2014 | Sportis | A47C 27/148 | 5/727 |
| 10,264,899 | B2 * | 4/2019 | Biebl | A47G 9/1081 | |
| 10,357,115 | B2 * | 7/2019 | Oh | A47C 27/144 | |
| 2005/0097676 | A1 * | 5/2005 | Rensink | A47C 27/001 | 5/721 |
| 2010/0270718 | A1 * | 10/2010 | Poppe | A47C 27/144 | 267/145 |
| 2015/0074911 | A1 * | 3/2015 | Dungan | A47G 9/1036 | 5/636 |

FOREIGN PATENT DOCUMENTS

| | | | | |
|---|---|---|---|---|
| DE | 10346684 | A1 * | 4/2004 | A47C 27/064 |
| DE | 10346684 | A1 | 4/2004 | |
| DE | 202014010183.3 | U1 | 10/2015 | |
| EP | 2421410 | B1 | 10/2012 | |
| JP | 2010259701 | A | 11/2010 | |
| RU | 45074 | U1 | 4/2005 | |

* cited by examiner

MATTRESS

The invention relates to a mattress having at least one first layer, a second layer and a third layer, wherein the second layer comprises spring elements and is arranged between the first and the third layer, typically is arranged directly between the first and the third layer. Such mattresses are generally known. The first and the third layer are conventionally composed of an elastic material, such as, for example, foamed material. In a case of conventional mattresses, all of the layers are uniformly thick, and therefore, in order to form a cuboid mattress, three cuboid layers are placed on one another, namely the lowermost cuboid foamed material layer, above the latter the spring elements in a cuboid arrangement, optionally embedded in a frame, and above the latter a cuboid foamed material body as the third body.

If a person lies on a mattress, different points of the mattress are exposed to different weights. The hip region of the person is, for example, heavier than the shoulder region, and the head and the feet are even lighter. It is known to take this into account by different spring elements having a different spring force being arranged in various arrangements along the longitudinal extent of the mattress, i.e. along its lying direction, in which head region, shoulder region, hip region and foot region follow one another. This is highly complicated to produce.

It is the object of the invention to develop a mattress according to the prior art in such a manner that the local weights of the person lying on the mattress are taken into account, but at the same time the mattress can be produced more simply and cost-effectively. According to the invention, the object is achieved in that the thickness of the third layer (which thickness is defined as the distance of an outer surface, which faces away from the second layer, of the third layer from the second layer) varies locally to an extent which goes beyond the extent which is predetermined by a surface structure of the third layer on its outer surface. Although there may therefore be certain surface variations which deviate from a flat outer surface, the overall variation of the thickness of the third layer is greater. This has the effect that the surface of the third layer, which surface faces the second layer, is no longer flat, but rather ensures the variation in the thickness by means of a suitable structure.

Although the mattress according to the invention can additionally be provided with spring elements of variable spring strength, a particular advantage consists specifically in that a different spring force is predetermined because of the variation in the thickness of the third layer by means of the material of the third layer and optionally of the first layer. As a result of respectively resilient elements, such as of the first layer, the spring elements of the second layer and of the third layer, it makes a difference whether the first layer is thicker or thinner. It is therefore possible simply by means of suitable cutting or suitable shaping of the first layer as a whole, to very rapidly ensure a variation in the spring force over the mattress.

In a preferred embodiment, the outer surface of the third layer is flat at least in sections and preferably continuously. The outer surface of the third layer can thereby define a lying side directly or as a base for a rather thinner fourth layer, or conversely can define the side facing a slatted frame of a bed.

In a further preferred embodiment of the invention, the variation takes place continuously in one direction, i.e. not in steps. Placing of the third layer on the spring elements of the second layer is thereby made possible in a particularly simple manner. The mattress is intended to have, in a manner known per se, a longitudinal extent with a head region, a shoulder region, a hip region and a foot region, and the variation of the thickness of the third layer is intended to take place precisely in the direction of the longitudinal extent in order to take into account the different requirements of the weight loading at the head, the shoulder, at the hip and at the foot of the person lying on the mattress.

Furthermore preferably, it is provided for this purpose that the mattress also extends in a transverse direction perpendicular to the longitudinal extent, wherein the thickness of the third layer in the transverse direction remains constant at different points of the longitudinal extent. A longitudinal section through the mattress is therefore identical overall. This takes account of the fact that different people tend to lie on different points of a mattress, one person rather in the center of the mattress, the other rather at the edge. It would nevertheless also be possible to allow the variation of the thickness to alternatively take place over the transverse extent, and therefore the person lies, for example, as in a hollow.

In particular with no variation in the transverse direction, it is advantageous if a plurality of recesses extending with a constant cross section in the transverse direction is provided, wherein the cross section is preferably dependent on the thickness of the third layer. By means of these recesses, the extent of which according to definition is smaller than the variation of the thickness, the third layer can yield somewhat in the longitudinal direction in order to be able to better yield to forces which resemble shearing forces and which occur because of the varying thickness. The recesses can alternatively or additionally also be provided in the first layer.

Although the variation of the thickness can be continuously rising or continuously falling, the thickness preferably initially decreases and then increases again in the direction of the longitudinal extent. There is therefore at least one point in the central region of the longitudinal extent where the thickness of the third layer is at maximum.

The thickness preferably decreases repeatedly and/or increases repeatedly, i.e. decreases in different regions which are separated from at least one region having an increasing thickness of the third layer, and/or increases in different regions which are separated from at least one region having a decreasing thickness of the third layer. The mattress can thereby be adapted individually to the body of an individual person.

In a further preferred embodiment of the invention, the thickness of the first layer, which thickness is defined as the distance of the outer surface, which points away from the second layer, of the first layer from the second layer, increases in a direction in which the thickness of the third layer decreases, and vice versa. The first layer therefore at least partially compensates for the variation of the third layer. As a result, the variation in thickness in the mattress body as a whole is not very apparent on the outside. Particularly preferably, it is provided here that the overall thickness of the mattress is constant at least in sections. This is the case if the thickness of the first layer increases in one direction to the same extent by which the thickness of the third layer decreases, and vice versa. The mattress then appears from the outside like a conventional mattress, i.e. can be in particular cuboid.

The variation of the thickness of the third and/or the first layer preferably takes place to an extent which is at least one third, preferably at least half and furthermore preferably at least two thirds of the thickness of the second layer. The spring elements are therefore not all perpendicular, but rather stand a little transversely, as a result of which the locally acting spring force can be adjusted particularly easily.

In a manner known per se, the first and/or the third layer are composed of foamed material or comprise foamed material.

The spring elements can comprise pocket springs, spring cores and/or foamed material springs and are preferably designed in the manner of the foamed material springs from EP 2 421 410 B1: said foamed material spring has a tubular, resilient body which is composed of foamed material and forms an outer wall, with holes which extend inward from an outer surface to an inner surface, wherein said holes are arranged in a staggered symmetry and are substantially diamond-shaped, wherein the tubular body has the holes only over a limited part of its surface, and wherein said limited part regularly alternates with a limited part of the surface that is not provided with the holes and that forms longitudinally directed reinforcing ribs in the wall of the tubular body of the spring.

Furthermore preferably, it is provided that a fourth layer is arranged on the third layer of the mattress, the thickness of which fourth layer preferably remains constant over all of the directions of extent.

Figure 2:
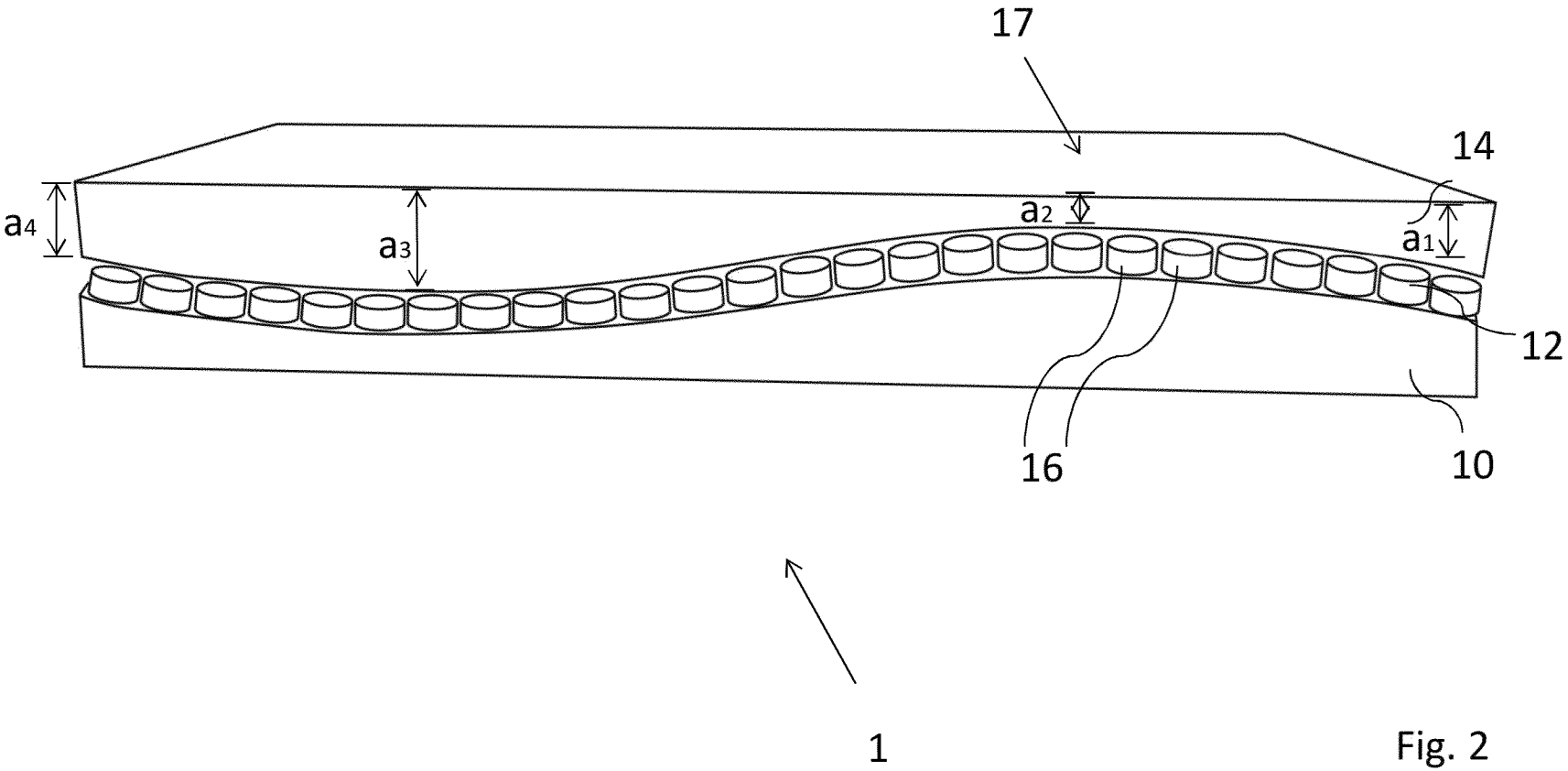
Figure 3:
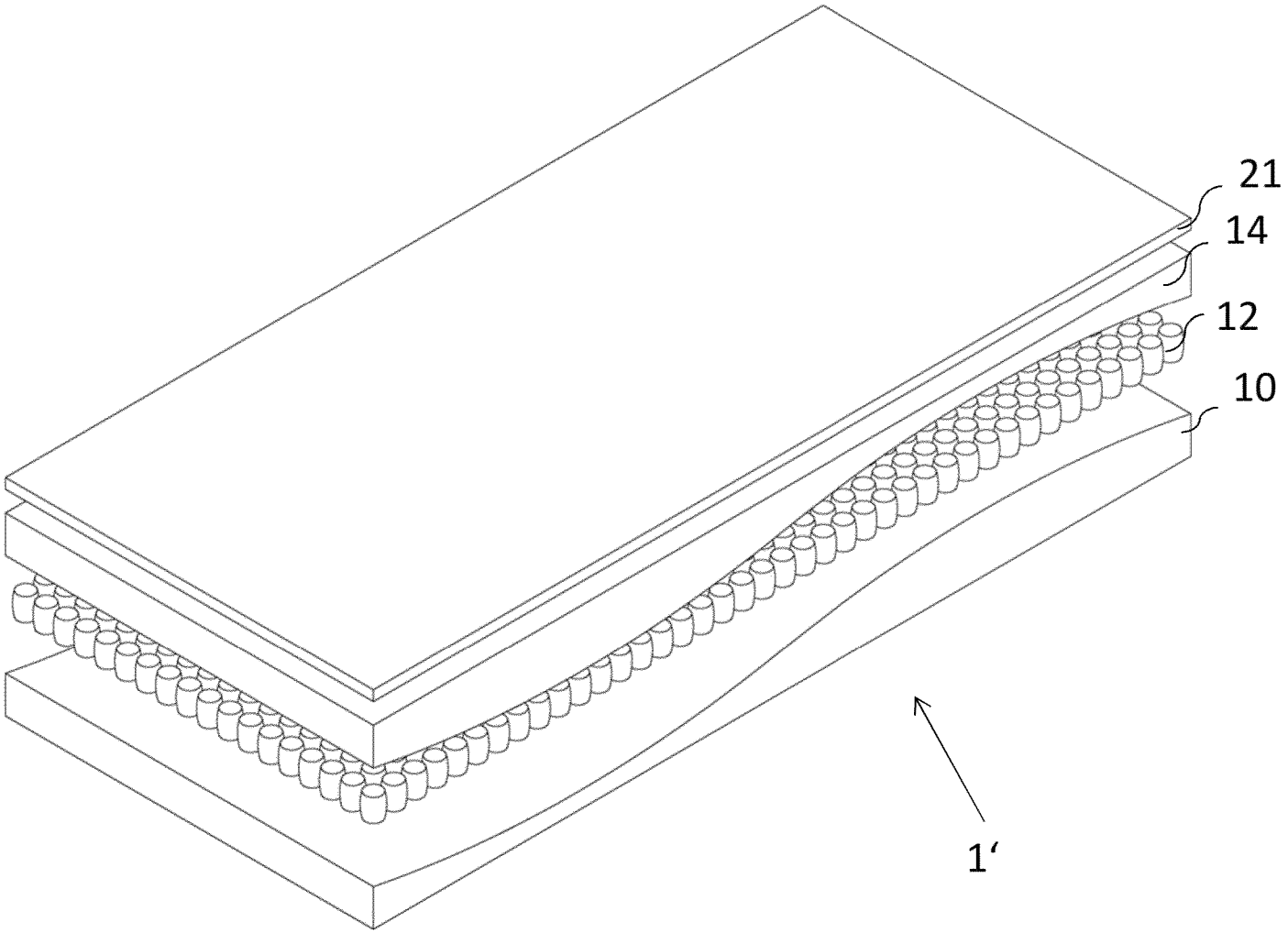
Figure 4:
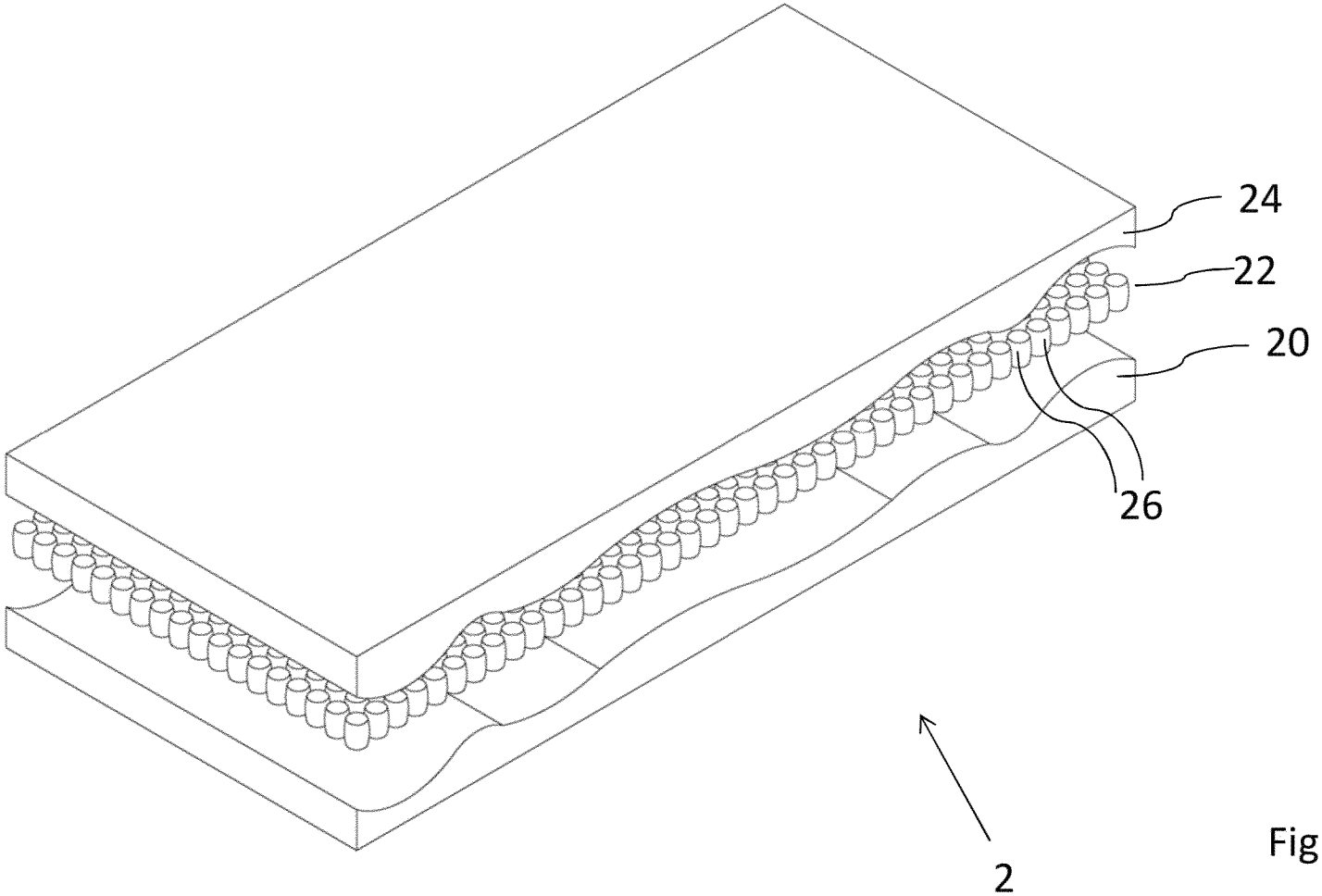
Figure 5:
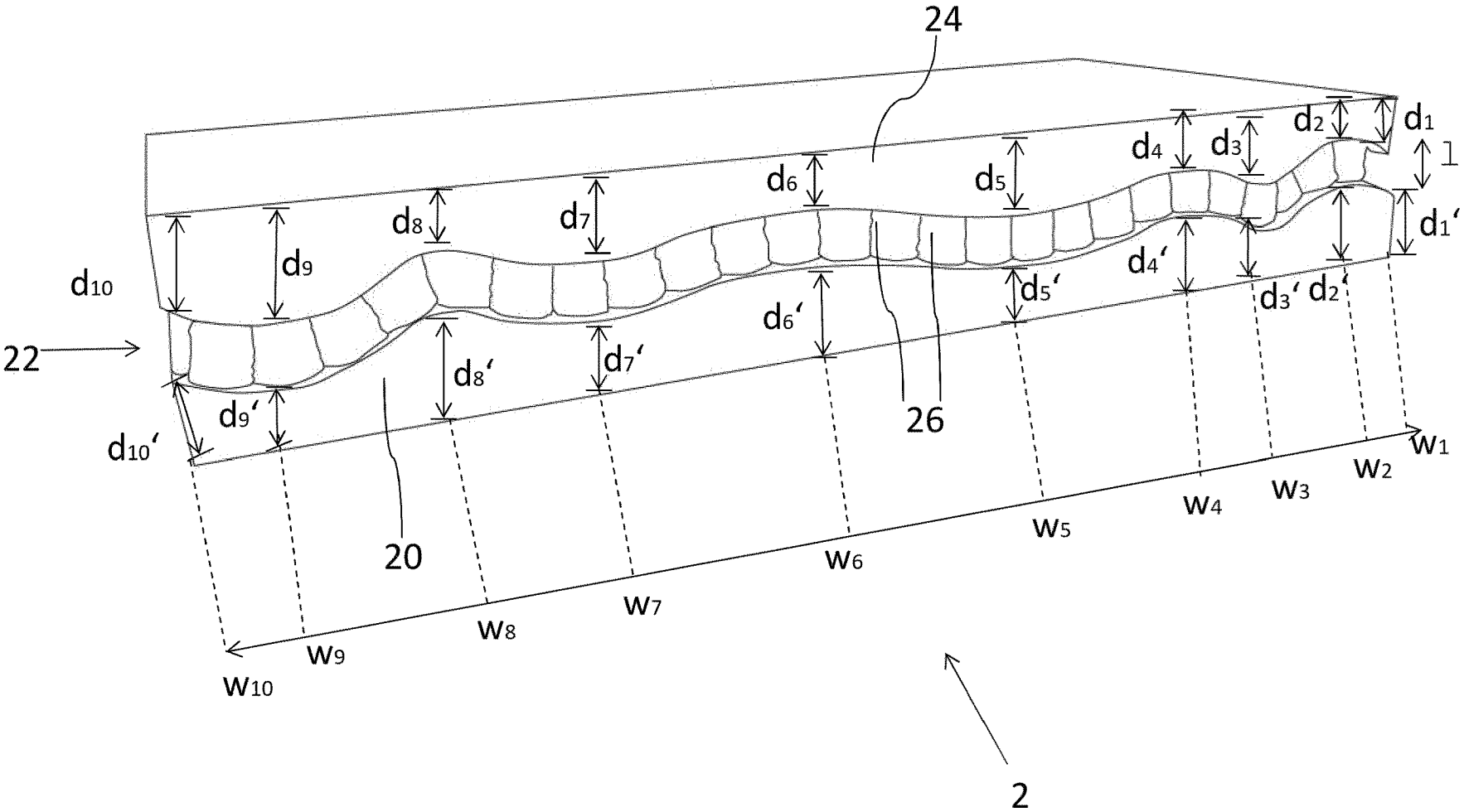
Figure 6:
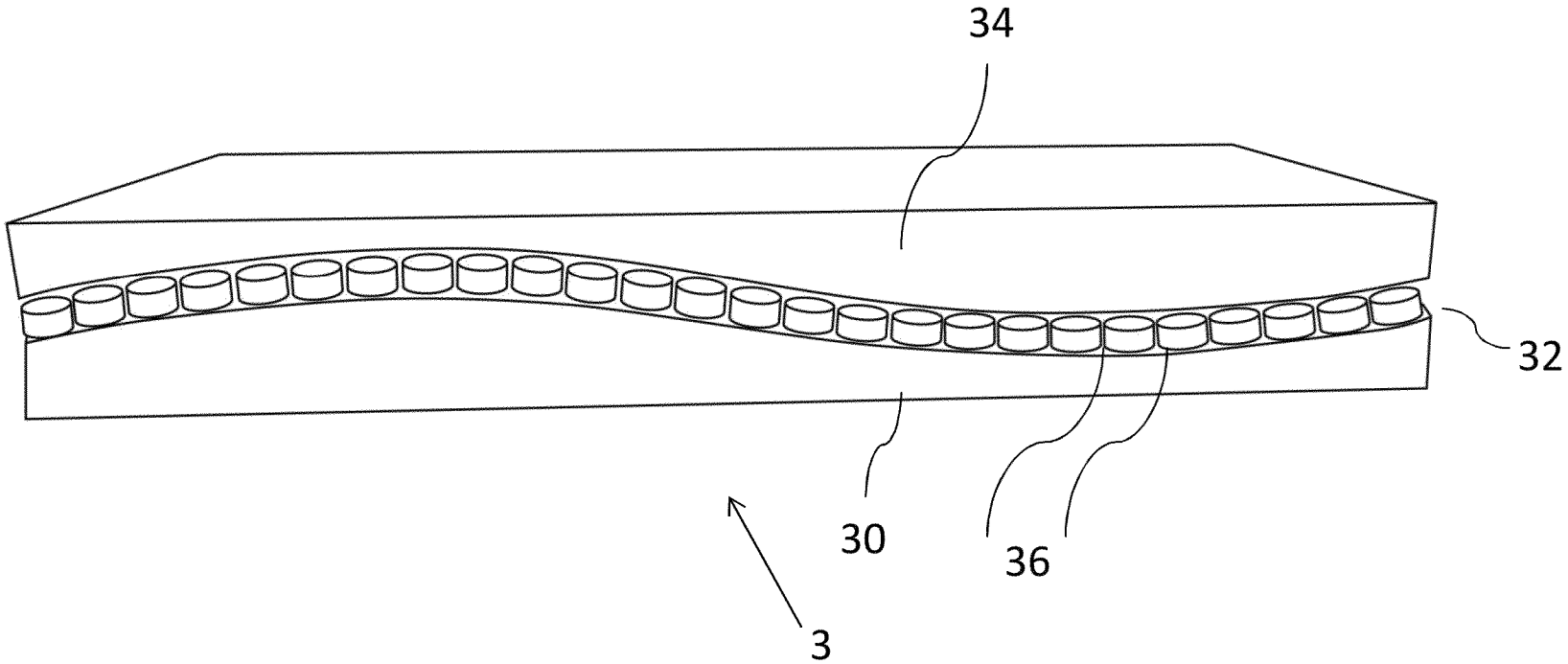

Preferred embodiments of the mattress according to the invention will be described in more detail below with reference to the drawing, in which:

FIG. 1 is a perspective view of a first embodiment of the mattress according to the invention, FIG. 2 shows a longitudinal section of the mattress from FIG. 1, FIG. 3 is a perspective view of a modification of the mattress from FIG. 1, FIG. 4 is a perspective view of a second embodiment of the mattress according to the invention, FIG. 5 shows a longitudinal section of the mattress from FIG. 4, and FIG. 6 shows a longitudinal section of a third embodiment of the mattress according to the invention.

A mattress, which is denoted overall by 1, according to a first embodiment comprises a first layer 10 of foamed material, a second layer 12 of spring elements 16, and a third layer 14 of foamed material. The spring elements 16 can be composed of metal or can be designed in the manner of the foamed material spring element according to EP 2 421 410 B1. As is apparent in a longitudinal section from FIG. 2, in the case of the mattress 1 the thickness $a_1$, $a_2$, $a_3$ of the third layer 14 varies over the longitudinal extent. The longitudinal extent corresponds to the x axis, which is shown in FIG. 1. The transverse extent of the mattress corresponds to the y axis shown in FIG. 1. The thickness extends along the z axis. The thickness of the third layer is defined as the distance between the surface 17 of the third layer 14, which surface faces away from the second layer 12, from the second layer 12. In the case of the mattress 1, the thickness in the head region is $a_1$ and is reduced up to a shoulder region $a_2$. Further in the x direction toward the feet, the thickness then increases further to the size $a_3$, in order then to be reduced again at the foot end to $a_4$. In other words, the thickness of the mattress decreases once, then increases again and then decreases again slightly. The shape approximately follows a sine curve, but is not limited thereto. The mattress 1 has a substantially cuboid shape: the thickness of the first layer 10 increases to the extent that the thickness of the third layer 14 decreases, and vice versa, and therefore the overall thickness remains constant when the thickness of the second layer 12 remains the same.

In the case of the mattress 1, it is not envisaged that the thickness will vary in the transverse direction (according to the y axis). The surface 17 can be provided with fine structures, namely in particular in the form of recesses 18*a*, 18*b* and 18*c*, wherein the recesses 18*a* of the third layer 14 are largest at an average thickness, are very small in the event of a small size and are likewise very small at a great thickness, see reference signs 18*b* and 18*c*. The first layer has corresponding recesses, the cross section of which has a constant cross section over the transverse direction (y axis), see the recesses 19*a* and 19*b* in FIG. 1.

In the case of the modification of the mattress 1' according to FIG. 3, a fourth layer 21 is provided as a further layer, which fourth layer can likewise be composed of foamed material and, for example, is composed of a somewhat harder foamed material than the foamed material layers 10 and 14. The fourth layer 21 can equally also be composed of softer foamed material or of an entirely different material, such as, for example, a plastics sheet.

In all of the embodiments of the invention, the foamed material of the entire mattress can be generally be of constant hardness in one layer or of varying hardness. In one embodiment, it is thus possible for the effect of a smaller or a greater thickness to be supported by varying the hardness of the foamed material, that is to say a smaller hardness is also present when the thickness is smaller and a greater hardness when the thickness is greater, or precisely an opposite effect is produced, i.e. a smaller hardness when the thickness is greater and a greater hardness when the thickness is smaller.

In the case of the second embodiment of the mattress 2, shown in FIG. 4, the thickness of the mattress varies substantially more intensively. In a region $w_1$ above the head, the thickness $d_1$ is of average size in order to decrease to the region beyond the head to the thickness $d_2$, wherein the thickness $d_3$ is increased again where the head lies and the thickness $d_4$ is decreased again where the neck lies. In the region of the shoulders, the thickness $d_5$ is increased again, and is then decreased again to $d_6$ in the following region of the upper body, is increased in the region of the posterior to $d_7$, is reduced to $d_8$ in the region of the thigh and knee, is increased again to $d_9$ in the region of the feet and is decreased again to $d_{10}$ at the foot end. The corresponding thicknesses $d'_1$, $d'_2$, $d'_3$, . . . , $d'_{10}$ of the first layer 20 vary in parallel in an opposed manner to the thickness of the first layer, and therefore for each $d_i$, where i=1 to 10, the following always applies: $d_i+1+d'_i=D$, wherein D is a constant of the thickness of the mattress 2. In the example, for example, the distance $w_1$ to $w_2$ is 10 cm, $w_2$ to $w_3$ is 20 cm, $w_3$ to $D_4$ is 15 cm, $w_4$ to $w_5$ is 25 cm, $w_5$ to $w_6$ is 30 cm, $w_6$ to $w_7$ is 30 cm, $w_7$ to $w_8$ is 25 cm, $w_8$ to $w_9$ is 25 cm and $w_9$ to $w_{10}$ is 10 cm.

The variation in the thickness, for example $d_1$ minus $d_2$, $d_2$ minus $d_3$, etc. is preferably greater at least for individual pairs of successive $d_i$ than the thickness of a spring element 1. Since the thickness of the second layer 22 directly corresponds to the thickness □ of the individual spring elements 26, the thickness of the third layer 24 and the thickness of the first layer 20 therefore vary to an extent which is greater than the thickness of the second layer 22. The extent of the variation is at least one third of the thickness □ of the second layer 22, preferably at least half and preferably at least two thirds.

A common feature of the previously shown mattresses 1, 1' and 2 is that foamed material springs which are tubular and quite long are used. FIG. 6 shows a modified form with the first layer 30, the second layer 32 and the third layer 34, which form differs from the embodiment according to FIG. 1 in that larger foamed material springs 36 are used.

In all of the embodiments, owing to the fact that the thickness of the first layer and of the third layer change appropriately with respect to each other, it is ensured that the foamed material elements 16, 36 in a layer arranged two-dimensionally do not always stand parallel to the direction z of the thickness, but rather obliquely (also with respect to the perpendicular of the surface 17). A lateral deflection is thereby made possible. This increases the comfort when lying on the mattress. When different points of the body experience the thickness of the third layer 14, 24, 34 differently, depending on where a person lies and specifically transverse forces arise by means of the oblique position of the spring elements 16, 36, the person on the mattress feels particularly comfortable.

The invention claimed is:

1. A mattress, comprising: a longitudinal extent with a head region; a shoulder region; a hip region; a foot region; at least one first layer; a second layer; a third layer; and a plurality of recesses in the at least one first layer and/or in the third layer, wherein the second layer comprises spring elements and is arranged between the at least one first layer and the third layer, wherein a thickness of the third layer, which is defined as a distance of an outer surface, which faces away from the second layer, of the third layer from the second layer, varies locally to an extent which goes beyond an extent which is predetermined by a surface structure of the third layer on the outer surface, wherein the variation in the thickness of the third layer occurs in a direction of the longitudinal extent, wherein the mattress also extends in a transverse direction perpendicular to the longitudinal extent, wherein the thickness of the third layer in the transverse direction remains constant at different points of the longitudinal extent, wherein the plurality of recesses extends with a constant cross section in the transverse direction, wherein the cross section of the plurality of recesses is dependent on the thickness of the third layer, wherein recesses of the third layer are largest at an average thickness and smaller at a thickness greater than the average thickness, wherein the recesses of the third layer are smaller at a thickness smaller than the average thickness than the grooves at the average thickness.

2. The mattress of claim 1, wherein the outer surface of the third layer is flat at least in sections.

3. The mattress of claim 1, wherein the outer surface of the third layer is continuously flat.

4. The mattress of claim 1, wherein the variation in the thickness of the third layer is continuous in one direction.

5. The mattress of claim 1, wherein the thickness of the third layer initially decreases and then increases again in the direction of the longitudinal extent.

6. The mattress of claim 5, wherein the thickness of the third layer decreases in the direction of the longitudinal extent in different regions which are separated by at least one region having an increasing thickness of the third layer, and/or increases in different regions which are separated by at least one region having a decreasing thickness of the third layer.

7. The mattress of claim 1, wherein a thickness of the at least one first layer, which is defined as a distance of an outer surface which points away from the second layer, of the at least one first layer from the second layer, increases in a direction in which the thickness of the third layer decreases, and wherein the thickness of the at least one first layer decreases in a direction in which the thickness of the third layer increases.

8. The mattress of claim 7, wherein a variation in the thickness of the at least one first layer takes place to an extent which is at least two thirds a thickness of the second layer.

9. The mattress of claim 1, wherein the variation in the thickness of the third layer takes place to an extent which is at least two thirds of a thickness of the second layer.

10. The mattress of claim 1, wherein the at least one first layer and/or the third layer comprises foamed material.

11. The mattress of claim 1, wherein the spring elements comprise pocket springs, spring cores and/or foamed material springs.

12. The mattress of claim 1, wherein the spring elements comprise foamed material springs having a tubular, resilient body composed of foamed material and forming an outer wall, with holes which extend inward from an outer surface to an inner surface, wherein the holes are arranged in staggered symmetry and are substantially diamond-shaped, and wherein the tubular body has the holes only over a limited part of a surface of the tubular body, the limited part alternating regularly with a limited part of the surface that is not provided with the holes and that forms longitudinally directed reinforcing ribs in the wall of the tubular body.

* * * * *